United States Patent [19]

Nuzman et al.

[11] 4,133,379

[45] Jan. 9, 1979

[54] FORAMINOUS SCREENING DEVICE AND METHOD FOR MAKING SAME

[76] Inventors: Carl E. Nuzman, R.R. 1, Silver Lake, Kans. 66539; John S. McGuire, 823 N. Hamilton, Olathe, Kans. 66061

[21] Appl. No.: 834,694

[22] Filed: Sep. 19, 1977

Related U.S. Application Data

[63] Continuation-in-part of Ser. No. 698,405, Jul. 21, 1976, abandoned.

[51] Int. Cl.[2] ..... E03B 3/20; E21B 43/08

[52] U.S. Cl. ..... 166/234; 210/497.1; 210/510; 156/175

[58] Field of Search ..... 210/496, 497 R, 497.1, 210/499, 504, 505, 507, 508, 509, 510; 55/525, 527; 156/155, 161, 162, 165, 172, 173, 175, 189, 429; 166/227, 231, 232, 233, 234, 236; 264/137

[56] References Cited

U.S. PATENT DOCUMENTS

| | | | |
|---|---|---|---|
| 1,629,018 | 5/1927 | Coberly | 210/497 |
| 2,037,164 | 4/1936 | Harah | 55/525 |
| 2,633,729 | 4/1953 | Slaughter | 210/497 |
| 2,718,583 | 9/1955 | Noland et al. | 156/172 |
| 2,755,216 | 7/1956 | Lemons | 156/155 |
| 2,837,456 | 6/1958 | Parilla | 156/161 |
| 3,105,043 | 9/1963 | Rich et al. | 210/497.1 |
| 3,399,092 | 8/1968 | Adams et al. | 156/173 |
| 3,516,448 | 6/1970 | Baker | 156/175 |
| 3,692,607 | 9/1972 | Shobert | 156/175 |
| 3,728,189 | 4/1973 | Hannes et al. | 156/161 |
| 3,864,182 | 2/1975 | Shobert et al. | 156/172 |
| 3,870,637 | 3/1975 | Sanjo et al. | 210/497.1 |

FOREIGN PATENT DOCUMENTS

| | | | |
|---|---|---|---|
| 1349821 | 11/1962 | France | 210/497.1 |
| 350433 | 1/1962 | Switzerland | 156/172 |
| 516701 | 1/1972 | Switzerland | 210/508 |

*Primary Examiner*—Frank W. Lutter
*Assistant Examiner*—David L. Lacey
*Attorney, Agent, or Firm*—Fishburn, Gold & Litman

[57] ABSTRACT

A foraminous screening device comprising a cylindrically tubular body having a plurality of spaced apart apertures therethrough and including a network of helically shaped ribs. The network includes first and second rib sets both having a plurality of mutually parallel and axially spaced ribs therein. The ribs of the first set have a clockwise orientation and are connected at points of intersection to the ribs of the second set which are oriented in a counterclockwise direction. Each of the ribs comprises a plurality of axially disposed, overlying bundles of tensed glass filament which are interconnected and embedded in a matrix of hardened synthetic resin. The ribs are interwoven at each point of intersection, and each bundle constitutes a portion of a continuous, elongated glass filament strand.

8 Claims, 11 Drawing Figures

FORAMINOUS SCREENING DEVICE AND METHOD FOR MAKING SAME

This application is a continuation-in-part of our U.S. patent application Ser. No. 698,405, filed July 21, 1976, now abandoned.

The invention relates to foraminous screening devices, and in particular to water well screens.

Screens for water wells have conventionally been fabricated from metallic materials such as iron, steel and the like which are readily susceptible to attack by electrolyis and erosion, structurally weakening the screen and depositing foreign substances in the water. Further, the constant flow of abrasive particles, such as suspended sand, causes the softer, non-metallic materials to erode. In water wells of the larger variety, such as those used for industrial and irrigational purposes, such devices are generally quite larger and consequently quite expensive. Also, the repair of such large water wells is necessitated when the screens therein deteriorate, and such repair is a very costly and time consuming undertaking. Hence, well screens are preferably constructed of a material which is substantially impervious to both corrosion and erosion. The screen must also be strong and rigid to withstand axial compression loading induced by the weight of interconnected upstanding well pipe, radial compression caused by the weight of displaced bed material particularly in gravelwall type wells, and bending stress caused by uneven compressive loading such as by shifting portions of the gravel bed.

Glass filament well screens have been used to alleviate the corrosion and erosion problems inherent in well screens fabricated from metallic materials. However, the glass filament well screens could not be economically commercially formed with the combination of accurately shaped openings for efficient pumping, and sufficient structural strength to gain wide industry acceptance. To achieve the required strength characteristics in glass filament well screens, it is imperative that the glass filaments be set under tension, and preferably, that the unit be formed from a continuous glass filament strand.

To achieve continuous filament construction, the filament must be wound under tension on a mandrel which has been precisely shaped to accurately form the desired screen openings. When the tensed filament is wound about the ends of the mandrel, the tension in the fibers causes the same to slide axially inwardly in an elastic manner toward the center of the mandrel, thereby placing slack in the ends. The end portions with untensed filament must then be cut off to reach a tensioned zone in the wound member, thereby destroying the continuously wound feature as well as losing the consequent strength which is desired therefrom.

The principal objects of the present invention are: to provide a well screen which is fabricated of a plurality of tensed glass filaments embedded in a matrix of hardened synthetic resin material for improved resistance to corrosion, erosion and similar causes of structural degredation; to provide such a well screen having a network of helically shaped and interwoven ribs for improved structural strength; to provide such a well screen wherein each of the ribs comprises a plurality of axially oriented overlying bundles of glass filament; to provide such a well screen wherein each of said bundles constitutes a portion of a continuous, elongated glass filament strand for improved screen strength and rigidity; to provide such a well screen having accurately formed openings for efficient water pumping, and being continuously wound for increased structural strength; to provide such a well screen wherein the outer surface thereof is peaked at each rib intersection for increased strength and improved flow characteristics; to provide such a well screen having means integrally attached to each end thereof for sealingly joining at least two screen members together in and end-to-end fashion; to provide such a well screen wherein a cylindrically tubular body thereof is adapted to be formed by winding the filament bundles about a cylindrical mandrel having a plurality of helically shaped grooves therein; to provide such a well screen wherein the wound filament does not axially slide at the ends thereof; to provide such a well screen wherein the mandrel is removable from the ribs by liquifying the mandrel; and to provide such a well screen which is economical to manufacture, efficient in use, capable of a long operating life, and particularly well adapted for the proposed use.

Other objects and advantages of this invention will become apparent from the following description taken in connection with the accompanying drawings wherein are set forth by way of illustration and example, certain embodiments of this invention.

The drawings constitute a part of this specification and include exemplary embodiments of the present invention and illustrate various objects and features thereof.

Figures 1, 2, 3, 4, 6, 7:
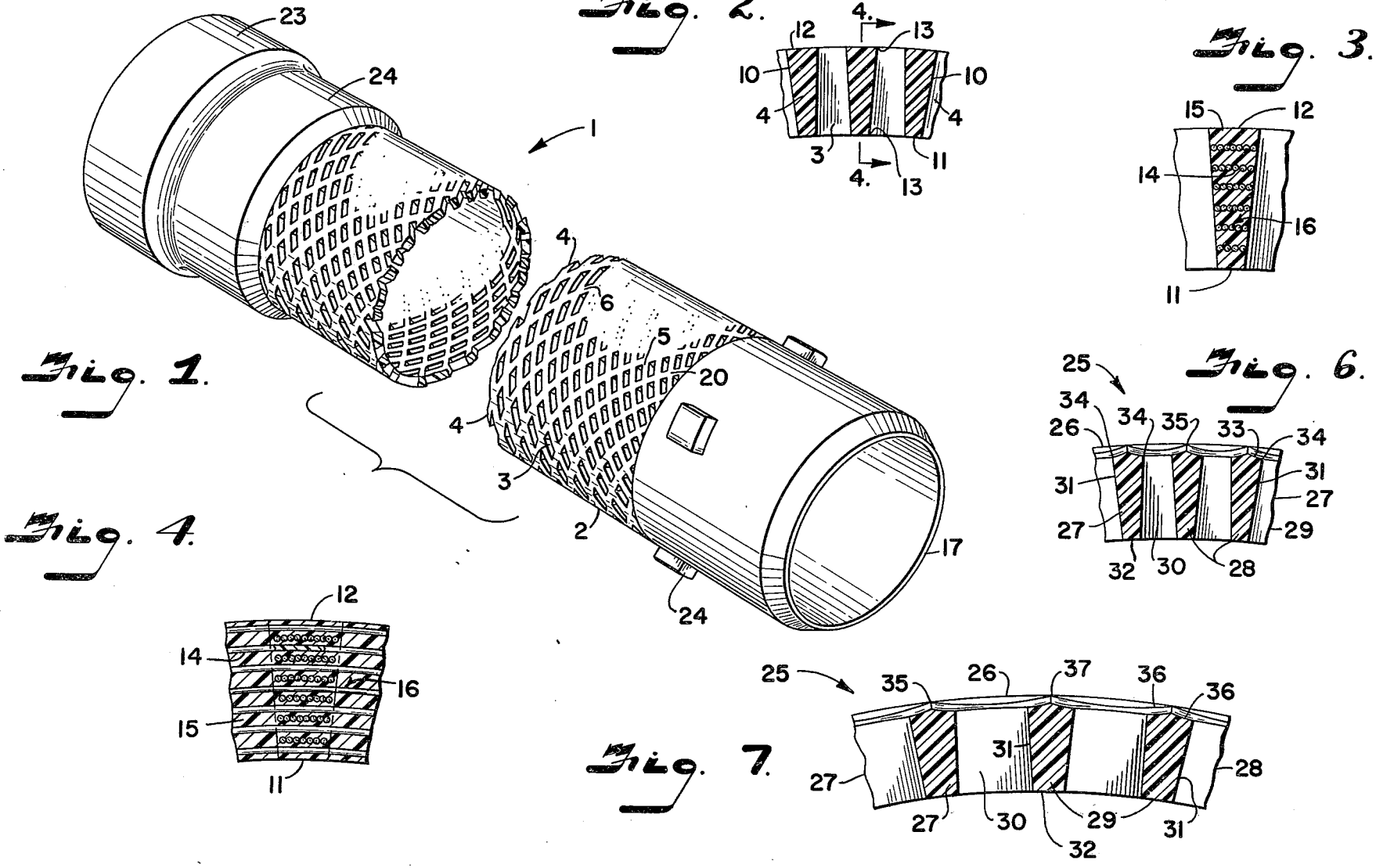
FIG. 1 is a fragmentary perspective view of a foraminous screening device embodying the present invention and having means disposed on each end thereof for axially joining similarly shaped screening members.
FIG. 2 is a cross-sectional view of the screening device taken through the wall portion thereof along a plane parallel to one of the rib sets.
FIG. 3 is an enlarged, fragmentary, cross-sectional view of the screening device taken laterally through the wall portion thereof.
FIG. 4 is an enlarged, fragmentary, cross-sectional view of the screening device particularly showing intersecting rib portions and being taken along line 4—4, FIG. 2.
FIG. 6 is a fragmentary, cross-sectional view of the peaked well screen embodiment taken along a plane parallel to one of the rib sets.
FIG. 7 is a cross-sectional view of the peaked well screen embodiment taken along a plane parallel to the other rib set.

Referring more in detail to the drawings:

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The reference numeral 1 generally designates a foraminous screening device having a cylindrically tubular, self-supporting body 2 with a plurality of spaced apart, accurately formed apertures 3 therethrough. The screening device comprises a network of elongated, helically shaped ribs 4 which are divided into first and second, oppositely oriented, sets 5 and 6 respectively.

Each rib 4 is helically shaped, and includes opposing side walls 10, a radially inward face 11, and a radially outward face 12. In operation, a suction is created inside the screening device by a pumping mechanism (not shown) and well water is thereby caused to flow through the apertures 3 thereof, directionally from the outward face 12 to the inward face 11. The opposing side walls of each rib 4 preferably converge in a direction radially inward of the body 2, such that objects will not become wedgingly trapped in the apertures and thereby restrict flow therethrough. In the illustrated structure, the rib faces 11 and 12 have a slightly arcuate shape for improved screen rigidity. The corners 13 of the ribs may be rounded (not shown) to improve fluid flow characteristics through the apertures.

Each of the ribs 4 comprises a plurality of axially oriented, imperforate or solid, glass fibers or filaments 14 which are interconnected and imbedded in a matrix of hardened resin or plastic 15 under tension. In FIGS. 3 and 4, the reference numeral 14 designates any one of the similarly shaped glass filaments, including those segments disposed transversely and having the leader line directed thereto, as well as those cut by the section plane 4—4 and having a circular cross section in the plane of the page. The glass fibers are arranged in bundles 16 in which a coating of resin is disposed about each filament therein to prevent abrasion between any of the glass fibers. In this example, the bundles are ribbon-shaped being arranged in rows positioned in a spaced apart and substantially parallel fashion between the rib faces 11 and 12. Along the axial axis of the rib, the faces 11 and 12 are arcuate conforming with the cylindrically tubular shape of the body 2.

The ribs 4 are arranged in a network and comprises the first and second rib sets 5 and 6. Each set of ribs includes a pluarlity of mutually parallel and axially spaced ribs therein. The ribs of the first set 5 have a clockwise orientation as viewed from end 17 thereof and connected at points of intersection 20 to the ribs of the second set 6 which are oriented in a counterclockwise direction. The ribs intersect in a manner which forms the apertures 3 with a quadrilateral cross-sectional shape. As best illustrated in FIG. 4, the ribs are interwoven at each point of intersection 20 for increased strength and rigidity. Preferably, the ribs of the first set 5 are continuous and integral with the ribs of the second set 6. Both the first and second rib sets 5 and 6 may be oriented at any selected angle or pitch to fulfill the axial and radial stress requirements of the specific application. For example, if the screening device 1 is to support the weight of an upstanding well casing, preferably both rib sets 5 and 6 should have a relatively steep pitch, such as an angle of 80° × 80° to withstand the intense axial loading. If high hoop stresses are anticipated, the pitch of at least one of the rib sets should be relatively fine, in the nature of a 15° inclination to the central axis, to provide sufficient radial body support. In the illustrated structure, both the first and second rib sets are oriented at an angle in the nature of 60° from the device's central axis. Also, the number and size of the ribs 4 in each set, can be varied to adjust the shape of the apertures 3 and to accomodate specific screening requirements. In one example, the width of a rib of the first set is equal to one-half of the width of a rib of the second set, while the total number of the former is twice that of the latter. Preferably, the sets intersect at an angle of other than 90°, whereby greater contact area between overlying bundles 16 is achieved at each point of intersection 20, thereby strengthening the body structure.

The screening device includes first and second ends 17 and 23 respectively, each of which includes a joint member 24 thereon for connecting two or more of such devices in a sealed, end-to-end relationship. The joint may include any suitable attachment mechanism, and in this example, is illustrated as having a cam-lug device such as that disclosed in U.S. Pat. No. 3,701,548.

Another embodiment of the present invention, generally designated by the numeral 25 (FIGS. 5, 6 and 7), includes an irregular, peaked outer surface 26 which increases the screening device's strength and pumping efficiency. The irregular outer surface 26 prevents the occurence of the smooth wall interface effect which will reduce lateral and vertical fluid flow through the screening device. The peaked well screen embodiment 25 is similar to the previously described screen embodiment and includes ribs 27 arranged in first and second sets 28 and 29 respectively which form frustro-pyramidal apertures 30 therebetween. Each rib includes opposing side walls 31, which in the illustrated structure, converge in a direction radially inward of the outer surface 26. An inward face 32 of the rib 27 is preferably slighly arcuate, and outward faces 33 slant arcuately upwardly from outer edges 34 thereof to a center portion 35. In a similar manner, the ribs of the second set 29 have arcuate faces 36 and are peaked at each point of intersection 37 with the ribs of the first set 28.

Figures 5, 8, 9, 10, 11:
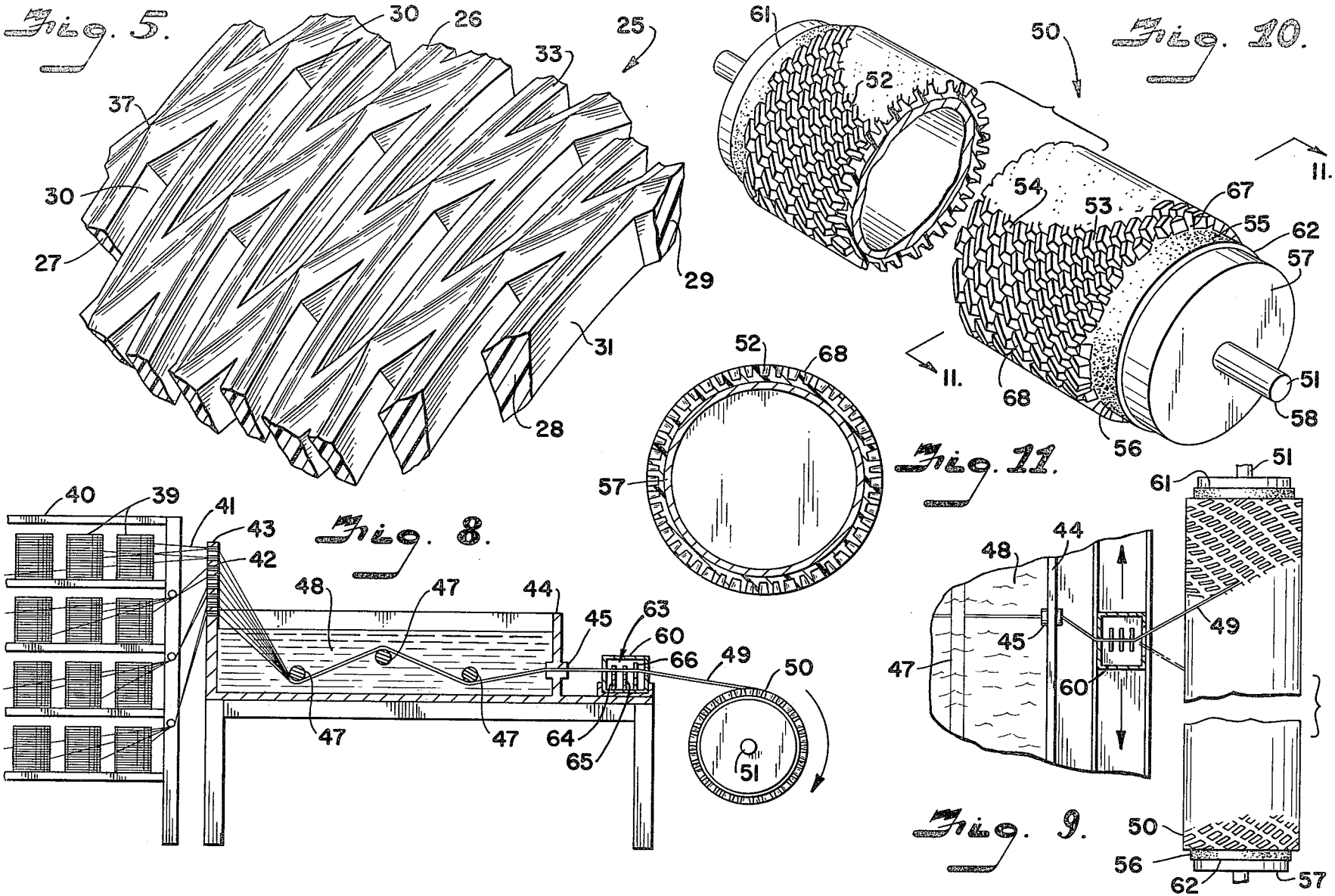
FIG. 5 is a fragmentary perspective view of another embodiment of the present invention having a peaked exterior surface.
FIG. 8 is an elevational view, partially in diagrammatic form, of an apparatus for manufacturing the well screen in accordance with a method embodying the present invention.
FIG. 9 is a fragmentary top elevational view of the apparatus shown in FIG. 8.
FIG. 10 is a fragmentary perspective view of a mandrel for use with the apparatus of FIG. 8.
FIG. 11 is a vertical cross-sectional view of the mandrel taken along line 11—11, FIG. 10.

A method for manufacturing the foraminous screening device includes the practice of a device such as that illustrated in FIG. 8. A plurality of spools 39 each having glass filament wound thereon, are supported by a suitable creel structure 40. The glass fibers or threads 41 are wound helically about the spools such that they may be payed easily therefrom. Each thread 41 is drawn from its respecitve spool 39 and passed through a companion aperture 42 in a flat guideplate 43 which is mounted to the rear of a suitable, elongated vessel 44 having an apertured gathering die 45 in the distal end thereof. Transverse of the vessel or tank 44 are a series of fixedly mounted, smooth, horizontal steel rods 47 which are disposed beneath the surface of the liquid resin or plastic 48. A plurality of glass fibers or threads 41 are drawn through the bath vessel 44 and are passed between rods 47, thereby becoming thoroughly wetted or impregnated with the resin. The wetted filaments are then collected into a single continuous strand or bundle 49 by means of the die 45.

A cylindrical mandrel or form 50 (FIG. 10) is mounted for rotation about an axis 51 thereof in a lathe-like fashion. The form 50 includes a network of helical grooves 52 therein which correspond to and are adapted for forming the ribs 4 of the foraminous screening device. First and second groove sets 53 and 54 respectively, each comprises a plurality of mutually parallel and axially spaced grooves 52. The grooves of the first set 53 have a clockwise orientation and intersect the counterclockwise oriented grooves of the second set 54. The form 50 may be constructed in a conventional manner having a hollow center with a plurality of radial segments which collapse inwardly when disengaged from each other, and in the illustrated structure, is constructed of a liquefiable material, such as wax which has been molded into shape by a master (not shown). The form includes axial end members 55 having a roughened or knurled surface 56. An inner cylindrical member 57 supports the form and includes a rod 58 projecting therefrom for attachment to the rotating mechanism.

The form 50 is rotated, such as in the clockwise direction as illustrated by the arrow in FIG. 8, whereupon the strand 49 is wound under tension into a groove of the first set 53. A translating guide 60 feeds the bundle into the groove from one end 61 of the mandrel to the other end 62 thereof. The illustrated guide 60 includes a plurality of fiber forming mandrels 63 which are slidably mounted in the guide. Each of the mandrels 63 is movable from a retracted position wherein the same is spaced apart from the strand 49, to an extended position wherein the mandrel abuts the strand and selectively forms the same. In the illustrated structure, the strand 49 is comprised of 15 glass filaments, and one of the mandrels 64 is shaped to divide the strand into three, equal portions of five glass filaments each. A second one of the mandrels 65 is shaped to flatten the strand 49 into a ribbon shape wherein the glass filaments are positioned in a side-by-side manner, and a third mandrel 66 is provided to collect and form the filament into a single strand. The mandrels 63 are independently operated by means such as air cylinders which are capable of rapidly translating the same from the retracted to the extended position in a time period in the nature of 0.005 seconds.

As the strand 49 passes the end 67 of the groove 52, the guide 60 momentarily halts its translation, and the strand is thereby wound, under tension, about an arcuate portion of the roughly surfaced mandrel end member 55 which facilitates reversing the winding direction. Preferably, at each end of the feed travel, loaded plungers (not shown) will slow or retard the travel of the guide 60 during the winding operation on the mandrel end member 55. When the guide 60 has come to a complete halt, the angle of feed is reduced to 0° (zero degrees) and the strand 49 is wrapped about the same in a circular fashion instead of a helix. The mandrel 65 is then actuated to the extended position, and the rovings are flattened into a ribbon. A complete revolution of ribbon is wound onto the form end member 55 before the winding direction is reversed, such that the tension applied to the strand is retained therein, and substantially no axial slippage will occur. If the strand is not properly anchored on the mandrel end before the direction of feed is reversed, the tension in the line causes the same to slide in an elastic manner, axially toward the medial portion of the mold, thereby releasing the tension in the strands, placing slack therein, and consequently reducing the strength of the well screen.

The filament forming mandrel 65 is then retracted, and the mandrel 66 is engaged, thereby collecting and forming the filaments into a single strand. The direction of the translating guide 60 is then reversed, and the strand is wound into a groove with the second rib set 54 from the end 62 thereof to the mandrel end 61. This winding process is repeated until each of the first and second set grooves is filled to a predetermined point slightly below and uppermost edge 68 of the groove by a plurality of axially oriented overlying strands 49.

One of the guide mandrels 64 is shaped for separating the strand 49 into two or more distinct bundles for constructing screening devices having an asymetrical design, such as an unequal number of ribs 4 in each of the sets 5 and 6. The illustrated forming mandrel 64 is adapted to divide the strand into three equal portions or bundles for winding a screen having three times the number of ribs in set 5 than in set 6. As the guide 60 translate in the direction associated with the smaller ribs, each of the three, distinct bundles is wound contemporaneously into a separate mandrel groove 52. In this embodiment, after the forming mandrel 65 has been retracted and disengages the strand for reversing the winding direction, the forming mandrel 64 engages the strand and divides the same into three equal portions which are contemporaneously wound into the oppositely oriented mandrel grooves. When the guide 60 reaches the opposite end 62 of the mandrel, the forming mandrel 64 is retracted and disengages the strand, the second forming mandrel 65 engage the same to form a flat ribbon which is wound a complete revolution about the form end 55. After the last recited revolution is complete, the ribbon forming mandrel 65 is retracted, and the third mandrel 66 is extended to engage the strand, and collects and forms the fiber into a single strand for winding on the mold in the reverse direction, whereby, each of the mandrel grooves is evenly filled.

The mandrel 50 with wetted strands wound thereon is then placed into a curing atmosphere, such as heat, for a predetermined period of time, during which the resin sets and hardens. The mandrel 50 and the newly formed screening device are then separated. In practicing the mechanism illustrated in FIG. 10, the support member 57 is axially disengaged from the mandrel 50, and the same is subjected to conditions which will change the mandrel materials state of matter from a solid to a liquid, such as by melting or dissolving the wax. To facilitate manufacture, the wax preferably has a melting temperature above that temperature at which the strands are cured. The screening device may then be finished, such as by grinding the ends thereof and/or attaching joining members 24 thereto.

It is understood that while we have illustrated and described certain forms of our invention, it is not to be limited to the specific forms or arrangement of parts herein described and shown.

What we claim and desire to secure by Letters Patent is:

1. A method for manufacturing a cylindrically shaped, foraminous, self-supporting screening device comprising the steps of:

(a) wetting a plurality of solid glass filaments with a liquid, heat-hardenable, synthetic resin;

(b) collecting said wetted filaments into a continuous strand;

(c) providing a mandrel having first and second groove sets therein having opposing ends each with a peripheral surface; both of said sets having a plurality of mutually parallel, axially spaced and helically shaped grooves; the grooves of said first set having a clockwise orientation and intersecting the counterclockwise oriented grooves of said second set;

(d) tensing said strand;

(e) winding said strand under tension into a groove of said first set from one end of said mandrel to the other end thereof;
(f) anchoring said tensed strand by frictionally engaging the strand with the peripheral surface of the other mandrel end to lock the tension in a last wound segment of said strand;
(g) reversing the direction of said winding;
(h) winding said strand under tension into a groove of said second set from said other mandrel end to said one mandrel end;
(i) anchoring said tensed strand by frictionally engaging the strand with the peripheral surface of the one mandrel end to lock the tension in a last wound segment of said strand;
(j) repeating the steps of winding under tension into said first set groove, anchoring the strand at the one mandrel end to lock the tension into the last wound segment, reversing said winding direction, winding into said second set groove and anchoring the strand at the other mandrel end, until each of said first and second set grooves is filled to a predetermined point below and uppermost edge of said grooves; each of said tensed strands being embedded and interconnected in a matrix of synthetic resin;
(k) curing said tensed strands while the same are disposed on said mandrel; and
(l) removing the mandrel from said cured strands.

2. A method as set forth in claim 1 wherein:
(a) said anchoring to said mandrel other end step comprises:
(1) forming said strand into a flat ribbon after winding said strand into said first set groove;
(2) winding said ribbon under tension at least one revolution about said other mandrel end; and
(3) reforming said strand prior to winding said strand into said second set groove.

3. A method as set forth in claim 2 wherein:
(a) said reforming step comprises dividing said strand into at least two distinct bundles and winding said bundles under tension into separate grooves of said second set.

4. A method as set forth in claim 3 wherein:
(a) said anchoring to said mandrel one end step comprises:
(1) forming said strand into a flat ribbon after winding said strand into said second set groove;
(2) winding said ribbon under tension at least one revolution about said one mandrel end; and
(3) reforming said strand prior to winding said strand into said first set groove.

5. A method as set forth in claim 3 wherein:
(a) said mandrel is removed from said cured strands by liquefying said mandrel.

6. A method as set forth in claim 1 including:
(a) dividing said strand into at least two distinct bundles after said reversing step, and contemporaneously winding said bundles under tension into separate grooves of said second set; and
(b) reassembling said distinct bundles back into said strand before winding the same into another groove of said first set.

7. A method as set forth in claim 6 wherein:
(a) said mandrel is molded from wax and is removed from said cured strands by melting said wax.

8. A foraminous screening device comprising:
(a) a tubular, self-supported body having a plurality of spaced apart apertures therethrough and comprising a network of helically shaped ribs; wherein
(b) said network includes first and second rib sets both having a plurality of mutually parallel and axially spaced ribs therein; the ribs of said first set having a clockwise orientation and being interwoven and connected at points of intersection to the ribs of said second set; said second set being oriented in a counterclockwise direction;
(c) each of said ribs comprising a plurality of axially oriented, overlying bundles of tensed, solid, glass filament imbedded and interconnected in a matrix of hardened synthetic resin; each of said bundles constitutes a portion of a continuous, elongated glass filament strand; and
(d) said ribs being formed by the steps including:
(1) wetting a plurality of solid glass filaments with a liquid, heat-hardenable, synthetic resin;
(2) collecting said wetted filaments into a continuous strand;
(3) providing a mandrel having first and second groove sets therein having opposing ends each with a peripheral surface; both of said sets having a plurality of mutually parallel, axially spaced and helically shaped grooves; the grooves of said first set having a clockwise orientation and intersecting the counterclockwise orientated grooves of said second set;
(4) tensing said strand;
(5) winding said strand under tension into a groove of said first set from one end of said mandrel to the other end thereof;
(6) anchoring said tensed strand by frictionally engaging the strand with the peripheral surface of the other mandrel end to lock the tension in a last wound segment of said strand;
(7) reversing the direction of said winding;
(8) winding said strand under tension into a groove of said second set from said other mandrel end to said one mandrel end;
(9) anchoring said tensed strand by frictionally engaging the strand with the peripheral surface of the one mandrel end to lock the tension in a last wound segment of said strand;
(10) repeating the steps of winding under tension into said first set groove, anchoring the strand at the one mandrel end to lock the tension into the last wound segment, reversing said winding direction, winding into said second set groove and anchoring the strand at the other mandrel end, until each of said first and second set grooves is filled to a predetermined point below and uppermost edge of said grooves; each of said tensed strands being embedded and interconnected in a matrix of synthetic resin;
(11) curing said tensed strands while the same are disposed on said mandrel; and
(12) removing the mandrel from said cured strands.

* * * * *